US005842846A

United States Patent [19]

Fukuoka et al.

[11] Patent Number: 5,842,846

[45] **Date of Patent: *Dec. 1, 1998**

[54] HERMETIC TYPE COMPRESSOR HAVING AN OIL FEED PART

[75] Inventors: Hirotsugu Fukuoka; Hiroshi Matsunaga, both of Kusatsu; Keisuke Morita; Shinji Fujiwara, both of Otsu, all of Japan

[73] Assignee: Matsushita Electric Industrial Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 683,634

[22] Filed: Jul. 15, 1996

[30] Foreign Application Priority Data

Jul. 18, 1995 [JP] Japan ..... 7-181294

[51] Int. Cl.[6] ..... F04C 18/356; F04C 29/02

[52] U.S. Cl. ..... 418/63; 418/88; 418/94

[58] Field of Search ..... 418/63, 88, 94

[56] References Cited

U.S. PATENT DOCUMENTS

| | | | |
|---|---|---|---|
| 2,199,762 | 5/1940 | Smith | 418/63 |
| 3,056,542 | 10/1962 | Galin | 418/88 |
| 4,704,076 | 11/1987 | Kawaguchi et al. | 418/94 |
| 5,564,917 | 10/1996 | Leyderman et al. | 418/63 |

FOREIGN PATENT DOCUMENTS

| | | | |
|---|---|---|---|
| 1156598 | 10/1993 | Germany | 418/94 |
| 61-55391 | 3/1986 | Japan | 418/94 |
| 61-126394 | 6/1986 | Japan | 418/94 |
| 61-187585 | 8/1986 | Japan | 418/94 |
| 4159489 | 6/1992 | Japan | 418/63 |
| 4191494 | 7/1992 | Japan | 418/63 |

*Primary Examiner*—John J. Vrablik
*Attorney, Agent, or Firm*—Parkhurst & Wendel

[57] ABSTRACT

In a hermetic type compressor, a sliding part (11) between a main shaft (4) and a lower end plate (8) is large in wear, and it is not allowed to operate stably for a long period. By communicating between the sliding part (11) and an oil feed pump (9) through an oil feed port (12), refrigerating machine oil (2) is supplied by force into the sliding part (11), and hence the lubrication is improved and the reliability is enhanced. In particular, it is preferably applied to the hermetic type compressor using HFC derivative refrigerants.

2 Claims, 4 Drawing Sheets

HERMETIC TYPE COMPRESSOR HAVING AN OIL FEED PART

FIELD OF THE INVENTION

The present invention relates to a hermetic type compressor for compressing refrigerant gas in a refrigerating apparatus or air-conditioner.

BACKGROUND OF THE INVENTION

A conventional hermetic type compressor is described by referring to FIG. 6. FIG. 6 is a longitudinal sectional view of a hermetic type compressor.

In FIG. 6, a hermetic container 1 is filled with refrigerating machine oil 2 in its lower part. In the hermetic container 1, a motor 3 and a compressive mechanism 5 driven by a main shaft 4 of the motor 3 are disposed. The compressive mechanism 5 is composed of a cylinder 6, an upper end plate 7, a lower end plate 8 for plugging both end openings of the cylinder, and other parts.

The refrigerating machine oil 2 is supplied to sliding parts from an oil feed pump 9 provided in the main shaft 4 by the rotation of the main shaft 4, and these sliding parts are lubricated. Reference numeral 10 indicates a mist separator.

In the sliding parts of such compressive mechanism 5, wear becomes a problem in the sliding part of the main shaft 4 and lower end plate 8. That is, in the sliding part (contacting part) 11 of the contact between the main shaft 4 and lower end plate 8 slides along with the rotation of the main shaft 4, but this sliding part 11 is different from other sliding parts such as the sliding part of the main shaft 4 and upper end plate 7, not directly lubricated by the refrigerating machine oil 2 by the oil feed pump 9, and sufficient supply of the refrigerating machine oil 2 is not expected, and wear was often a problem.

As the refrigerant of such hermetic type compressor, hitherto, dichlorofluoromethane (hereinafter called CFC12) and hydrodichlorofluoromethane (hereinafter called HCFC22) were mainly used. As the refrigerating machine oil 2 charged in the hermetic container 1, naphthene derivative mineral oil and paraffin derivative mineral oil compatible with CFC12 and HCFC22 have been used.

These refrigerants and refrigerating machine oils 2 directly circulate in the hermetic container 1, and hence the compressive mechanism 5 is required to have wear resistance.

It has recently become known that, release of such refrigerants into the atmosphere destroys the ozone layer and has serious effects on human health and ecosystems, and the use of CFC12 and HCFC22 is being gradually limited, and further it has been agreed that they should be completely abolished in future.

In view of the above, various substitute refrigerants are being developed, including 1,1,1,2-tetrafluoroethane (hereinafter called HFC134a), pentafluoroethane (hereinafter called HFC125), hydrodifluoromethane (hereinafter called HFC32), and their mixed refrigerants.

These refrigerants HFC134a, HFC125, and HFC32 have low ozone layer breakdown coefficients, but are typically not compatible with mineral oils used as refrigerating machine oil together with CFC12 or HCFC22. Hence, when using HFC134a, HFC125, HFC32, or their mixed refrigerants as the refrigerant for hermetic type compressor, attempts have been made to use ester, ether or fluorine derivative oil compatible with such refrigerants as the refrigerating machine oil.

However, in the case of the hermetic type compressor using HFC134a, HFC125, or HFC32, instead of CFC12 or HCFC22, as the refrigerant, and using polyalkylene glycol derivative oil or polyester derivative oil compatible with such refrigerants as the refrigerating machine oil, the wear resistance of gray cast iron, special cast iron, and stainless steel used as the sliding members of the compressive mechanism 5 is lowered, and the hermetic type compressor cannot be operated stably for long periods.

One cause for the above-described lower performance is that lubricant film such as iron chloride is not formed and lubricating action is lowered because there is no chlorine atom in the compounds when HFC134a, HFC125, HFC32 and the like are used, whereas, in the case of conventional refrigerants such as CFC12 and HCFC22, chlorine (Cl) atoms existing as one of constituent atoms react with Fe atoms in the metal material to form iron chloride film which exhibits excellent in wear resistance.

Moreover, in the refrigerating machine oil of the conventional mineral oil derivatives, cyclic compounds were contained and the oil film forming capability was relatively high, but the refrigerating machine oil compatible with HFC134a, HFC125, and HFC32 is mainly composed of chain compounds, and a proper oil film thickness cannot be maintained in severe sliding conditions, which also lowers the wear resistance.

Therefore, in the hermetic type compressor using HFC134a, HFC125, and HFC32, that replace CFC12 and HCFC22, and using refrigerating machine oil compatible with these refrigerants, the sliding conditions are severe not only in high load conditions but also in ordinary load conditions, and especially the wear of the sliding part 11 of the main shaft 4 and lower end plate 8 is a serious problem.

DISCLOSURE OF THE INVENTION

The invention is directed to overcoming these and other problems, and it is hence a primary object thereof to present a hermetic type compressor improved in lubrication between the main shaft and lower end plate under severe sliding conditions, particularly in ordinary load conditions using HFC derivative refrigerants, and hence enhanced wear resistance and extended life.

To achieve these and other objects, in the hermetic type compressor of the invention, a motor and a compressive mechanism driven by a main shaft of the motor are disposed in a hermetic container, the compressive mechanism comprises a cylinder, and an upper end plate and a lower end plate for plugging both end openings of the cylinder, an oil feed pump for supplying refrigerating machine oil to parts is provided in the main shaft, an oil feed port formed in a sliding part of contact between the main shaft and lower end plate, wherein the oil feed port communicates with the oil feed pump.

According to the constitution of the invention, under normal operation, the refrigerating machine oil is supplied by force into the sliding part of the main shaft and lower end plate through the oil feed port from the oil feed pump provided in the main shaft, and therefore the lubricating state of this sliding part is improved, the wear resistance is enhanced, and the life is extended.

In a preferred embodiment of the invention, the oil feed port has a throttle.

According to this preferred embodiment, the refrigerating machine oil passing through the oil feed port is reduced in pressure at the throttle. At this time, the dissolved refrigerant is evaporated, and the refrigerating machine oil is cooled by the heat of vaporization, and the temperature of the refrigerating machine oil is lowered, and this cooled refrigerating machine oil is promptly supplied into the compression chamber, so that lowering of efficiency of the hermetic type compressor can be prevented without heating the intake refrigerant.

In an embodiment of the invention, a pore opened to the bottom is provided in the lower end plate, and another opening end of the pore is positioned at the sliding part of contact of the main shaft and lower end plate, at the low pressure chamber side of the compression chamber of the compressive mechanism.

According to this embodiment, the refrigerating machine oil can be supplied by force into the sliding part of the main shaft and lower end plate through the pore, and the lubricating state of this sliding part can be improved, and hence the wear resistance is enhanced and the life is extended. Besides, by adjusting the opening of the open end at the low pressure chamber side, the opening timing per revolution can be changed, and the oil feed rate of the refrigerating machine oil can be adjusted. As a result, the lubrication of the sliding part can be improved, and lowering of efficiency of the hermetic type compressor due to excessive supply of refrigerating machine oil can be prevented.

In a different embodiment of the invention, a nitride layer is formed or a bushing mainly composed of carbon is inserted in the sliding part of contact of the main shaft and lower end plate.

According to this different embodiment, the material of the opposite side of the sliding part is changed, and it is effective to prevent wear due to metal contact, especially prevent cohesive wear, and to lower the sliding resistance and reduce the power consumption of the motor.

That is, in the conventional refrigerant CFC or HCFC, when the combined load is high or temperature is high, or in the case of refrigerant HCF lowered in the lubricating performance, the lubrication tends to be insufficient. In such a case, microscopically, metal contact, the temperature becomes high due to friction, and those metals melt down, thereby leading to cohesion.

By contrast, in the last-mentioned embodiment, one side of the sliding part is made of a different metal such as a nitride layer or bushing, and cohesion of the contact area can be prevented. Besides, since the hardness is raised, it is more effective to prevent wear. Still more, since the nitride layer or the bushing can decrease the frictional resistance, the power consumption of the motor is saved, and a very efficient hermetic type compressor may be realized. In this constitution, without lowering the efficiency of the hermetic type compressor, the reliability of the sliding part, especially between the main shaft and lower end plate may be enhanced.

In the hermetic type compressor of the invention thus constituted, in particular, the refrigerant is an HFC derivative not containing chlorine atoms used either alone in mixture, and the refrigerating machine oil is a refrigerating machine oil compatible with the refrigerant, being packed in a hermetic container, and it is applied to the hermetic type compressor for composing a refrigerating or air-conditioning system.

In this constitution, even under normal load conditions using HFC derivative refrigerants, the lubrication of sliding part between the main shaft and lower end plate can be improved, and hence the wear resistance may be enhanced and the life may be extended.

EMBODIMENTS

Figure 1:
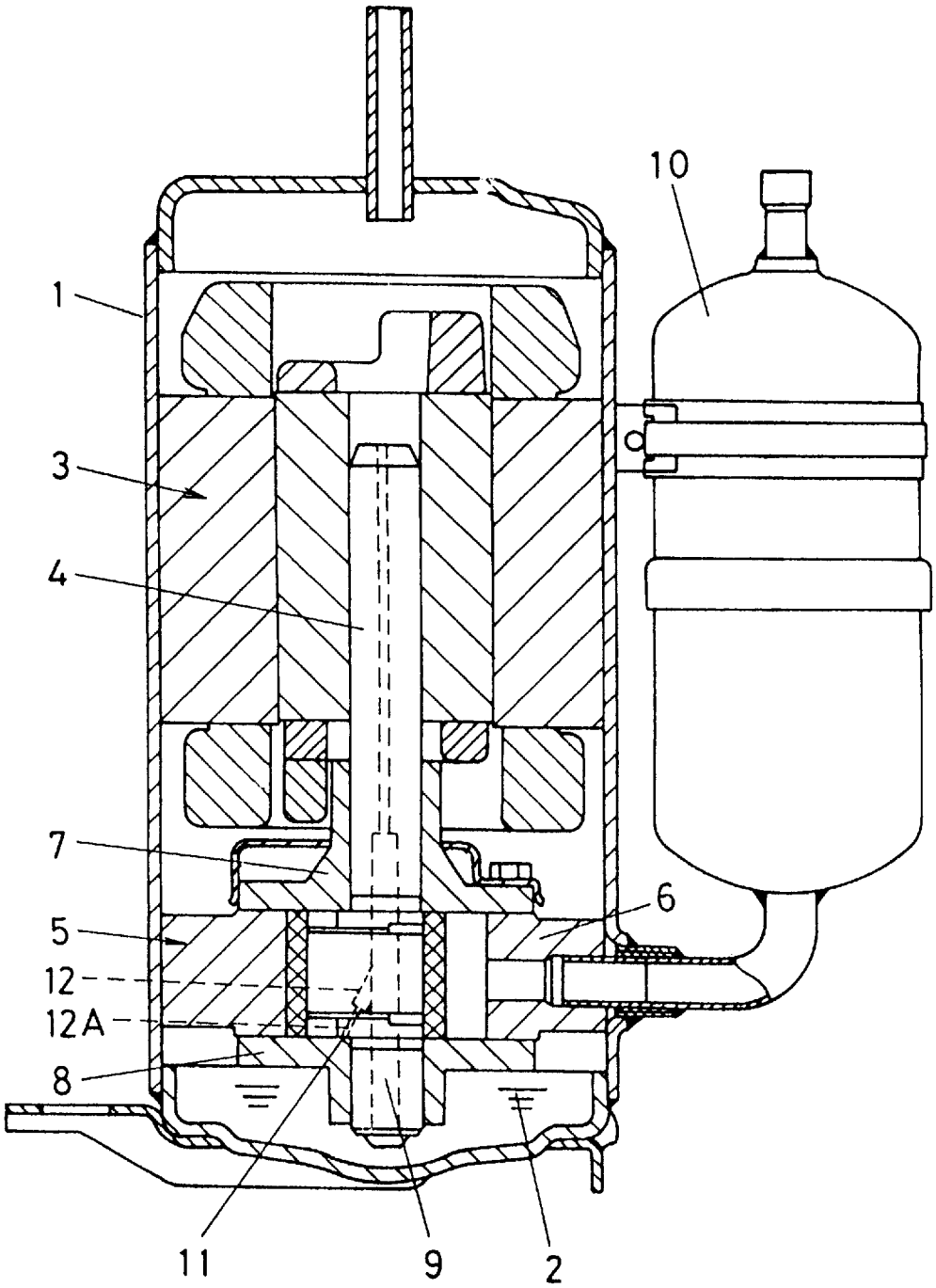
FIG. 1 is a longitudinal sectional view of a hermetic type compressor, showing a first embodiment of the invention.

A first embodiment of the hermetic type compressor of the invention is described by referring to FIG. 1. FIG. 1 is a longitudinal sectional diagram of the hermetic type compressor for explaining claims 1, 2, 6, and 7.

In FIG. 1, a hermetic container 1 is filled with refrigerating machine oil 2 in its lower part. In the hermetic container 1, a motor 3 and a compressive mechanism 5 driven by a main shaft 4 of the motor 3 are disposed. The compressive mechanism 4 is composed of a cylinder 6, an upper end plate 7 and a lower end plate 8 for plugging both end openings of the cylinder 6, and other parts.

As the refrigerating machine oil 2, when the refrigerant is CFC12 or HCFC22, generally, naphthene or paraffin derivative mineral oil, or alkyl benzene derivative is used. In the case of the refrigerant being an HFC derivative, ether or ester derivative oil compatible with the refrigerant is used.

By the rotation of the main shaft 4, the refrigerating machine oil 2 is supplied into sliding parts by an oil feed pump 9 provided in the main shaft 4, so that the sliding parts are lubricated. Reference numeral 10 indicates a mist separator.

In a sliding part 11 of contact between the main shaft 4 and lower end plate 8, however, since the refrigerating machine oil 2 is not supplied directly unlike the sliding part of the upper end plate 7 and main shaft 4, lubrication tends to be insufficient especially when the refrigerant is used in overloaded or high temperature operation, or when the refrigerant is a HFC derivative which has decreased lubricating performance, and cohesion or wear may occur in the sliding part (contact part) 11 between the main shaft 4 and lower end plate 8, thereby lowering the reliability.

Accordingly, an oil feed port 12 extends through the main shaft 4 and opens into area (sliding part) 11 of contact between the main shaft 4 and lower end plate 8, and this oil feed port 12 communicates with the oil feed pump 9. The oil feed port 12 has a throttle 12A.

In this constitution comprising the oil feed port 12, in usual operation, the refrigerating machine oil 2 is supplied by forced into the sliding part 11 between the main shaft 4 and lower end plate 8 through the oil feed port 12 from the oil feed pump 9 provided in the main shaft 4, thereby improving the lubricating state of the sliding part 11, and hence the wear resistance is enhanced and the life is extended.

Moreover, in the bottom of the hermetic container 1, the refrigerating machine oil 2 is high in temperature and pressure, but because of the throttle 12A formed in the oil feed port 12, the refrigerating machine oil 2 passing through the oil feed port 12 is reduced in pressure at the throttle 12A. At this time, the dissolved refrigerant is evaporated, and the refrigerating machine oil 2 is cooled by the heat of vaporization, and the temperature of the refrigerating machine oil 2 is lowered. The cooled refrigerating machine oil 2 is promptly supplied into the low pressure chamber 14 (see FIG. 3) side partitioned by a vane from the compression chamber, and thereby heating of the intake refrigerant is prevented, and lowering of efficiency of the hermetic type compressor is prevented.

Figure 2:
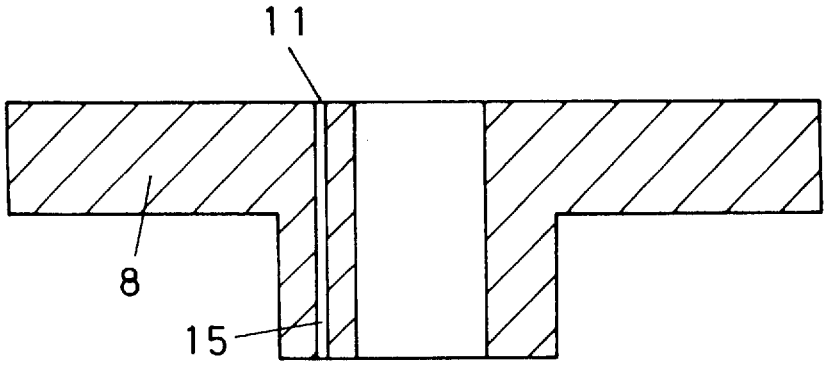
FIG. 2 is a longitudinal sectional view of a lower end plate, showing a second embodiment of the invention.
Figure 3:
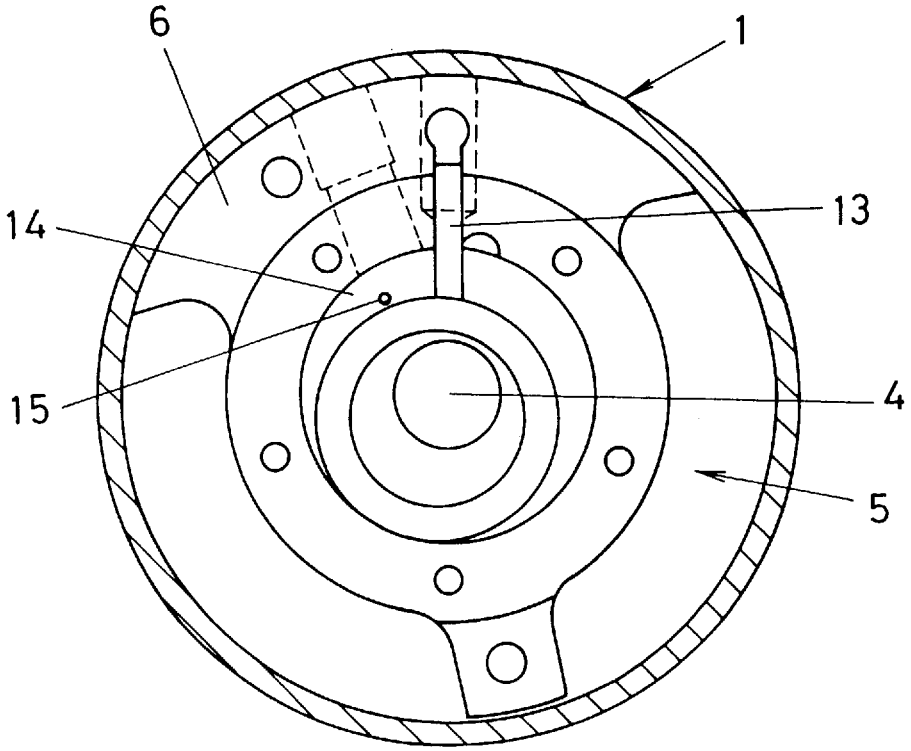
FIG. 3 is a cross sectional view of the same hermetic type compressor.

FIGS. 2 and 3 refer to a second embodiment of the hermetic type compressor of the invention. FIG. 2 is a longitudinal sectional view of the lower end plate 8 and FIG. 3 is a cross sectional view of the same hermetic type compressor.

In FIG. 2, a pore 15 open to the bottom is provided in the lower end plate 8, and another open end of the pore 15 is positioned at the sliding part 11 at the contact point of the main shaft 4 and lower end plate 8 and at the low pressure chamber 14 side in the compression chamber in the compressive mechanism 5.

According to the second embodiment, by the negative pressure suction force at the low pressure chamber 14 side, the refrigerating machine oil 2 is supplied by force into the sliding part 11 of the main shaft 4 and lower end plate 8 through the pore 15, thereby improving the lubricating state of the sliding part 11, improving the wear resistance, and extending the life. By adjusting the position of the opening end of the low pressure chamber 14 side, moreover, the opening timing per revolution is changed and the oil feed rate of the refrigerating machine oil 2 can be adjusted. As a result, the lubrication of the sliding part 11 is improved, and it is simultaneously effective to prevent excessive supply of the refrigerating machine oil 2 to lower the efficiency of the hermetic type compressor.

Figure 4:
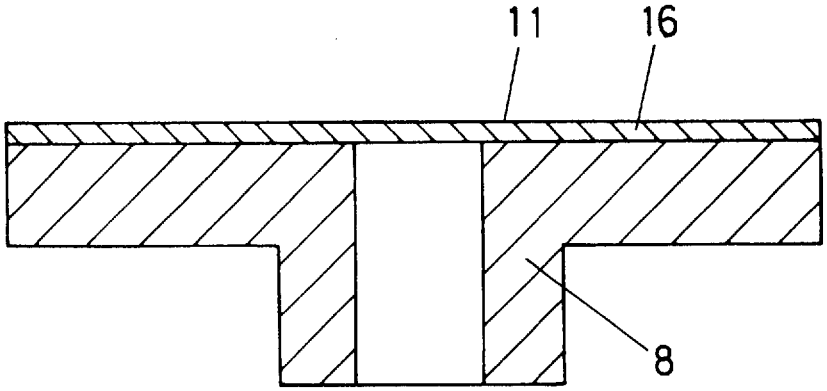
FIG. 4 is a longitudinal sectional view of a lower end plate, showing a third embodiment of the invention.

FIG. 4 shows a third embodiment of the hermetic type compressor of the invention. FIG. 4 is a longitudinal sectional view of the lower end plate 8.

In FIG. 4, the sliding part 11 of the main shaft 4 and lower end plate 8 is nitrided, and a nitride layer (FeN) 16 is formed on the sliding part 11. Herein, the nitride layer 16 is formed on the entire surface of the lower end plate 8 including the sliding part 11.

Conventionally, in refrigerant CFC or HCFC, when the load is high or temperature is high, or in the case of a HCF refrigerant that has lower lubricating performance, the lubrication tends to be insufficient. In such a case, microscopically, metal contact, the temperature becomes high due to friction, and the metal melts down, thereby leading to cohesion.

By contrast, as shown in the third embodiment, by nitriding the sliding part 11 to form a nitride layer 16, the sliding part 11 is made of dissimilar metals, and cohesion can be prevented. Besides, as the hardness is increased, the effect to prevent wear is further increased. Still more, the nitride film 16 can reduce the frictional resistance, and the power consumption of the motor 3 is saved, so that a very efficient hermetic type compressor may be realized.

Figure 5:
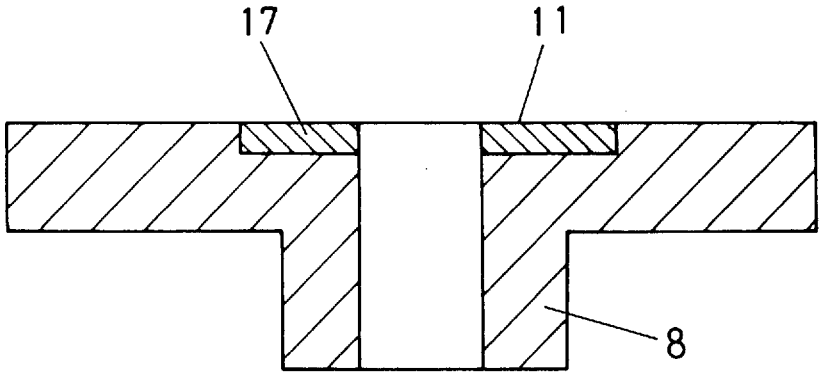
FIG. 5 is a longitudinal sectional view of a lower end plate, showing a fourth embodiment of the invention.
Figure 6:
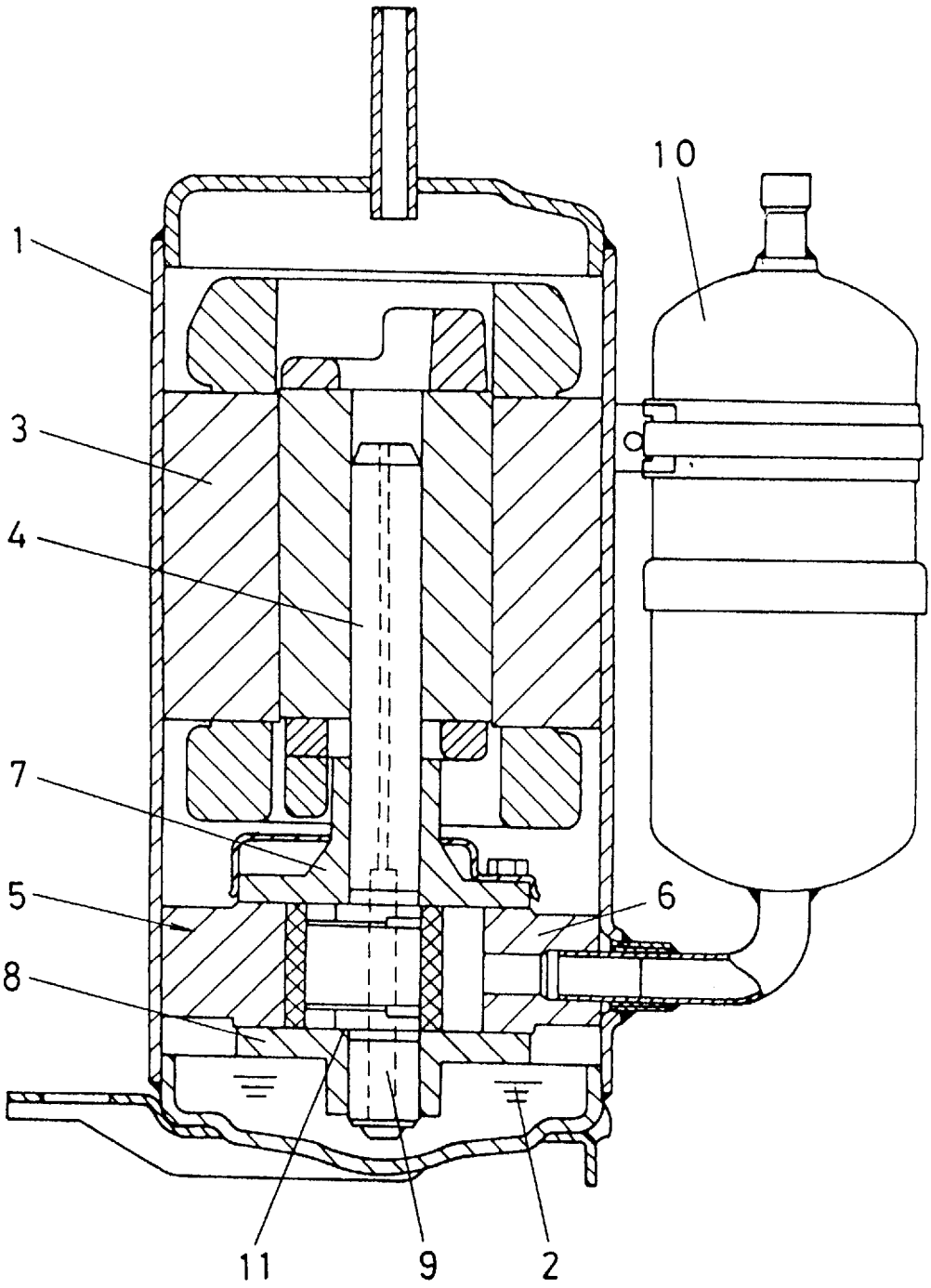
FIG. 6 is a longitudinal sectional view of a conventional hermetic type compressor.

FIG. 5 shows a fifth embodiment of the hermetic type compressor of the invention. FIG. 5 is a longitudinal sectional view of the lower end plate.

In FIG. 5, on the sliding part 11 at the contact point of the main shaft 4 and lower end plate 8, a bushing 17 mainly composed of carbon is inserted. Herein, the bushing 17 is fitted into the position of the sliding part 11 of the lower end plate 8.

In the case of the fourth embodiment, too, as in the third embodiment wherein a nitride layer 16 is formed by nitriding the sliding part 11, the sliding parts 11 are made of dissimilar metals, and cohesion is prevented. Besides, as the hardness is increased, the wear preventive effect is further increased.

In the hermetic type compressor according to the first to fourth embodiments, a refrigerant of HFC (hydrofluorocarbon) derivative not containing chlorine atoms is used alone or in mixture, and a refrigerating machine oil compatible with the refrigerant is packed in the hermetic container 1 as the refrigerating machine oil 2, and the refrigerating or air-conditioning system is constructed.

According to the embodiments, even under normal loads using HFC derivative refrigerants, the lubrication of the sliding part 11 between the main shaft 4 and lower end plate 8 under strict sliding conditions can be improved, thereby enhancing the wear resistance and extending the life of the hermetic type compressor.

What is claimed is:

1. A hermetic type compressor, comprising:

a hermetic container housing a motor and a compressive mechanism driven by a main shaft of the motor, the compressive mechanism including a cylinder, an upper end plate and a lower end plate for closing end openings of the cylinder, the main shaft and lower end plate slidingly contacting each other at a horizontally extending contact portion, an oil feed pump provided in the main shaft for supplying refrigerating machine oil to components in the hermetic container, and an oil feed port disposed slantedly downward in the main shaft and opening at the lower end plate at the contact portion, the oil feed port communicating with the oil feed pump.

2. A hermetic type compressor for a refrigerating or air-conditioning system operative with an HFC derivative refrigerant not containing free chlorine atoms or chlorine atoms in mixture as refrigerant, and having in a hermetic container a refrigerating machine oil compatible with the refrigerant as refrigerating machine oil, the compressor comprising:

a motor and a compressive mechanism driven by a main shaft of the motor disposed in the hermetic container, the compressive mechanism including a cylinder, an upper end plate and a lower end plate for closing end openings of the cylinder, the main shaft and lower end plate slidingly contacting each other at a horizontally extending contact portion, an oil feed pump provided in the main shaft for supplying refrigerating machine oil to components in the hermetic container, and an oil feed port disposed slantedly downward in the main shaft and opening at the lower end plate at the contact portion the oil feed port communicating with the oil feed pump.

* * * * *